US005204030A

United States Patent [19]

Kitajima et al.

[11] Patent Number: 5,204,030

[45] Date of Patent: Apr. 20, 1993

[54] METHOD FOR PRODUCING PITCH-TYPE CARBON FIBER

[75] Inventors: Eiji Kitajima, Izumi; Takashi Oyama, Izumi-Otsu; Makoto Kitai, Osaka-Sayama; Haruki Yamasaki, Isehara; Susumu Shimizu, Chuo, all of Japan

[73] Assignees: Koa Oil Company, Limited; Tanaka Kikinzoku Kogyo Kabushiki Kaisha, both of Tokyo, Japan

[21] Appl. No.: 793,461

[22] Filed: Nov. 18, 1991

[30] Foreign Application Priority Data

Nov. 16, 1990 [JP] Japan ..... 2-310597

[51] Int. Cl.[5] ..... D01F 9/12; D01F 11/10

[52] U.S. Cl. ..... 264/29.2; 264/211.11; 264/211.17; 264/518; 264/555; 423/447.1

[58] Field of Search ..... 264/29.2, 12, 555, 518, 264/210.8, 211.15, 211.17, 83, 211.11; 423/447.1, 447.6

[56] References Cited

U.S. PATENT DOCUMENTS 4,816,195 3/1989 Hettinger, Jr. et al. ..... 264/29.2
4,818,463 4/1989 Buehning ..... 264/40.1

FOREIGN PATENT DOCUMENTS 62-90320 4/1987 Japan .

*Primary Examiner*—Leo B. Tentoni
*Attorney, Agent, or Firm*—Wenderoth, Lind & Ponack

[57] ABSTRACT

A method for producing pitch-type carbon fiber, comprising the steps of discharging, from a spinning nozzle, a spinning pitch comprising an optically isotropic pitch and/or optically anisotropic pitch, maintained at such a temperature that the spinning pitch can have a viscosity of 20 poises or less, to form pitch fiber, while jetting a gas preheated to a temperature of 100° C. lower than the temperature at which the spinning pitch can have a viscosity of 20 poises or less, or higher from the periphery of the spinning nozzle in the same direction as the discharging direction of the spinning pitch and parallel to the discharged pitch fiber to give extremely fine fiber having an average diameter of 5 μm or less, and subjecting the thus spun fine fiber to infusibilization and carbonization.

2 Claims, 2 Drawing Sheets

METHOD FOR PRODUCING PITCH-TYPE CARBON FIBER

BACKGROUND OF THE INVENTION

This invention relates to carbon fiber, and more particularly to extremely fine pitch-type carbon fiber and a preparation method of the same.

In general, pitch-type carbon fibers are broadly classified into two groups, that is, high performance carbon fiber (HP product) and general purpose carbon fiber (GP product).

High performance carbon fiber is prepared by spinning an optically anisotropic spinning pitch to give fiber in which liquid crystalline molecules are arranged parallel to the axial direction of the fiber, and subjecting the fiber to infusibilization and carbonization to form graphite crystals thereon. High performance carbon fiber having high strength and high modulus can thus be obtained.

General purpose carbon fiber, on the other hand, is prepared by spinning an optically isotropic pitch as it is, followed by carbonization. The resulting carbon fiber is a non-graphitic optically isotropic material. General purpose carbon fiber having moderate strength can thus be inexpensively obtained.

Studies are now being made on application of the above conventional carbon fibers to practical use, in such a field that their characteristics and properties are supposed to be utilizable.

Heretofore, the high performance carbon fiber has been mainly prepared by a melt spinning method, and the general purpose carbon fiber, a centrifugal spinning method. Carbon fibers prepared by either method have a diameter of approximately 8 to 15 μm, and it is quite difficult to prepare fiber having a smaller diameter than the above by any conventionally known method.

Furthermore, carbon is intrinsically a brittle material, so that carbon fiber is inferior to fibers made from other materials in flexibility, and is easily broken.

For the above reasons, long carbon fiber requires careful handling; and short carbon fiber tends to be easily broken when preparing a composite material by mixing the carbon fiber with a plastic or concrete. In addition, papers, felts and mats which are produced by using short carbon fiber are poor in flexibility, so that they are easily damaged.

The above shortcomings can be eliminated if the diameter of the carbon fiber can be reduced. However, fine carbon fiber cannot be obtained by the conventional art due to mainly the below-described reasons:

In general, in the melt spinning method, a spinning pitch is discharged from a nozzle, and the discharged pitch fiber is wound up at high speed to finally obtain thin fiber. However, even the pitch fiber before being subjected to the winding has a low strength of approximately 0.4 kg/mm$^2$, so that finally obtainable fine fiber is to have an extremely low strength. On the other hand, stretching force which is applied to pitch fiber during spinning is increased as the diameter of the fiber decreases, in other words, as the winding speed is increased. When the stretching force finally becomes higher than strength of the pitch fiber, the fiber snaps, and the spinning cannot be stably continued any more.

In the centrifugal spinning method, on the other hand, a spinning pitch is discharged from a nozzle which is revolving at high speed, and the discharged pitch fiber is blown off by centrifugal force, thereby obtaining thin fiber. However, thin fiber has a low mass, so that it cannot be easily applied with force of inertia. For this reason, fiber cannot be made thin without limitation.

SUMMARY OF THE INVENTION

An object of the present invention is to provide an extremely fine carbon fiber which can contribute to drastic improvement in the properties of optically isotropic carbon fiber, optically anisotropic carbon fiber and a composite fiber thereof, which cannot be attained by any conventional technique.

To attain the above object, the present invention provides a preparation method of pitch-type carbon fiber, comprising the steps of discharging, from a spinning nozzle, a spinning pitch comprising an optically isotropic pitch and/or optically anisotropic pitch, maintained at such a temperature that the spinning pitch can have a viscosity of 20 poises or less, to form pitch fiber, while jetting a gas preheated to a temperature of 100° C. lower than the temperature at which the spinning pitch can have a viscosity of 20 poises or less, or higher from the periphery of the spinning nozzle in the same direction as the discharging direction of the spinning pitch and parallel to the discharged pitch fiber to give extremely fine fiber having an average diameter of 5 μm or less, and subjecting the extremely fine fiber to infusibilization and carbonization.

Since the carbon fiber obtained by the above-described preparation method of the invention has an extremely small diameter, remarkably improved flexibility is imparted thereto. Therefore, such a conventional problem that carbon fiber is broken when it is mixed with a matrix such as a plastic or concrete to prepare a composite material can be solved.

Furthermore, products such as papers, felts and mats prepared by using the above carbon fiber have an increased fiber density, high flexibility and high strength. Their properties can thus be largely increased.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

An optically isotropic pitch, an optically anisotropic pitch, or a mixture thereof can be used as the spinning pitch in the method of the present invention.

One of the reasons why extremely fine fiber can be obtained in the present invention is that a spinning pitch having a low viscosity of 20 poises or less is subjected to spinning. As described previously, pitch fiber snaps when stretching force applied to the pitch fiber during spinning becomes higher than strength of the pitch fiber. However, the stretching force decreases with a decrease of the viscosity of the spinning pitch. In the present invention, spinning can be conducted even when the spinning pitch has an extremely low viscosity of 20 poises or less, so that extremely fine fiber, which has never been obtained by any conventional method, is obtainable. For instance, in the case where long fiber is prepared by the aforementioned melt spinning method, pitch fiber snaps during spinning when a spinning pitch having a low viscosity is employed. Therefore, the lowest viscosity of the spinning pitch acceptable in this method is 100 poises. On the other hand, in the centrifugal spinning method, no special problem is practically brought about even if pitch fiber snaps during spinning, so that a spinning pitch having a viscosity lower than the viscosity acceptable in the melt spinning method can be used. However, the spinning pitch is to have a high surface tension when its viscosity is too low, and it cannot give fiber but gives liquid droplets. Therefore, the acceptable lowest viscosity of the spinning pitch is approximately 50 poises even in this method.

The other characteristic of the preparation method according to the present invention is that a gas stream is utilized in order to make pitch fiber thin. The viscosity of a spinning pitch is sensitively changeable depending on its temperature, so that when the pitch is cooled for a short time after discharged, its viscosity increases rapidly. It is therefore important to instantaneously make the discharged pitch thin. In the present invention, the gas stream is formed by jetting a gas in a specific manner so as to effectively and immediately make the pitch fiber thin. The jetting rate of the gas is preferably 100 m/sec or more. It is also preferable to preheat the gas to a temperature which is 100° C. lower than the discharging temperature, or higher. The sudden decrease in the temperature of the discharged pitch can thus be prevented.

It is necessary to jet the gas in the same direction as, and in a parallel direction to the discharging direction of the spinning pitch. In the case where the direction of the gas stream and the discharging direction of the spinning pitch are not substantially parallel to each other, the pitch fiber will snap before it is made thoroughly thin, and extremely fine fiber cannot be obtained.

Figure 1:
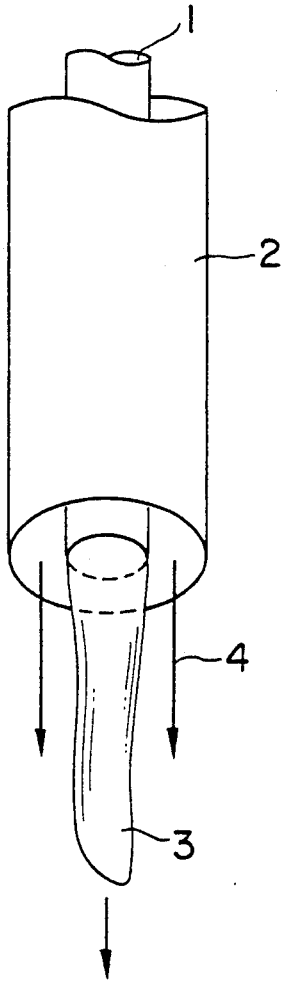
FIG. 1 is an illustration showing the portion of a nozzle of a spinning machine which is usable with the preparation method of pitch-type carbon fiber according to the present invention.

The illustration in FIG. 1 shows the portion of a spinning nozzle of a spinning machine for use with the above-described method of the present invention. The typical nozzle shown in this figure basically consists of a pitch nozzle 1 from which a spinning pitch is discharged, and a gas channel tube 2 through which a gas is jetted to form a gas stream around the nozzle 1. When a spinning pitch 3 is discharged from the nozzle 1, a preheated gas 4 is jetted parallel to the discharging direction of the spinning pitch. In the case of the spinning nozzle shown in this figure, the diameter of a discharging hole of the nozzle 1 is preferably 0.5 mm or less, more preferably 0.25 mm or less.

In the above-described method of the present invention, fiber having an average diameter of 5 μm or less, or even 2 μm or less can be obtained.

The above-obtained extremely fine pitch fiber is collected in a can, or on a belt conveyer, and then subjected to infusibilization and carbonization.

The infusibilization of the fiber can be conducted at any temperature. However, in general, it is conducted at a temperature of 220° to 300° C. The carbonization is carried out at a temperature of 700° to 3000° C.

In the method of the present invention, single fiber is also obtainable by spinning two or more kinds of spinning pitch. For instance, two or more kinds of spinning pitch, which are not blended, are supplied to a spinning machine, and are spun by means of the melt spinning method using a complex nozzle. Composite pitch fiber can thus be obtained as single fiber.

Other features of this invention will become apparent in the course of the following description of exemplary embodiments, which are given for illustration of this invention and are not intended to be limiting thereof.

Example 1

An optically isotropic pitch having a softening point of 200° C. was prepared by using heavy oil as a starting material, a by-product obtainable upon fluidized catalytic cracking of petroleum. The above spinning pitch was charged in a spinning machine having a pitch discharging nozzle with an inner diameter of 0.2 mm, and a gas jetting nozzle with an inner diameter of 0.5 mm provided at the periphery of the pitch discharging nozzle, and was heated to a temperature of 350° C. for melt. The viscosity of the molten pitch was 10 poises.

The spinning pitch was discharged from the nozzle at a rate of 100 mg/min while jetting a gas preheated to a temperature of 300° C. at a rate of 100 m/sec, thereby making pitch fiber thin. The pitch fiber thus obtained was infusibilized at a temperature of 260° C. in the air, and then carbonized at a temperature of 1000° C. under the atmosphere of nitrogen gas.

Figure 2:
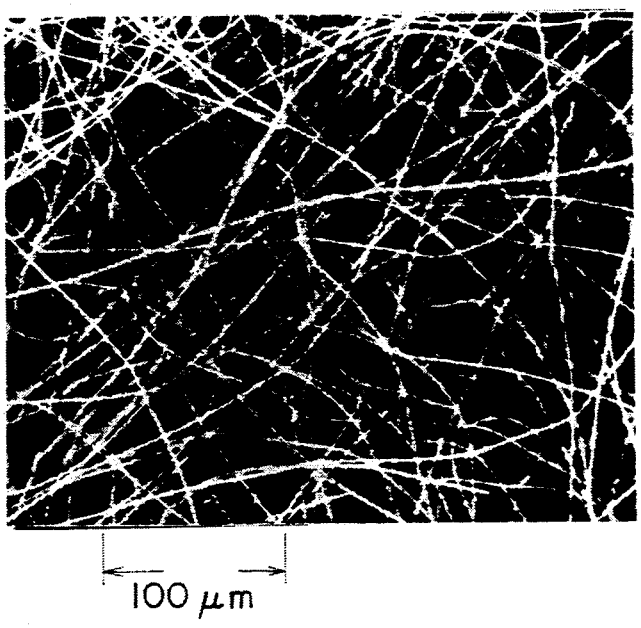
FIG. 2 and FIG. 3 are scanning electron microphotographs showing the shape of the carbon fiber which was obtained in Example 1, in accordance with the preparation method of the present invention.
Figure 3:
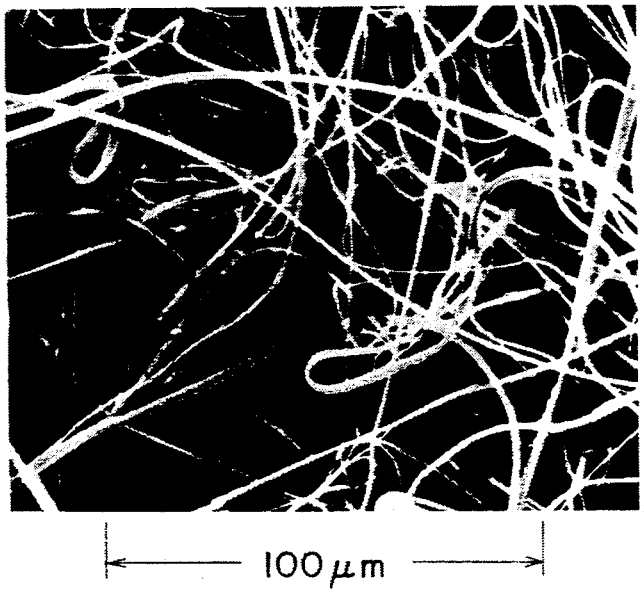

The strength of the above-obtained carbon fiber was 100 kg/mm$^2$. The average diameter of the fiber was 1.1 μm, and even the maximum diameter was as small as 4 μm. FIG. 2 and FIG. 3 are microphotographs showing the shape of the above carbon fiber.

Example 2

An optically anisotropic pitch having a softening point of 235° C. was prepared by using the same heavy oil as used in Example 1.

The above spinning pitch was charged in the same spinning machine as employed in Example 1, and was heated to a temperature of 370° C. for fusion. The viscosity of the molten spinning pitch was 10 poises. The pitch was discharged at a rate of 50 mg/min while jetting nitrogen gas preheated to a temperature of 350° C. at a rate of 100 m/sec, thereby obtaining pitch fiber. The pitch fiber was infusibilized at a temperature of 290° C., and then carbonized at a temperature of 1000° C.

It was found that the above-obtained carbon fiber had a small average diameter of 1.2 μm.

Comparative Example 1

The same optically isotropic pitch as used in Example 1 was heated to a temperature of 320° C. in the same spinning machine as employed in Example 1. The viscosity of the molten pitch was 100 poises. This spinning pitch was spinned in the same manner as in Example 1, followed by infusibilization and carbonization, whereby short carbon fiber was obtained. It was found that the carbon fiber had an average diameter of 15.5 μm, which was much larger than the diameter of the carbon fiber obtained in Example 1.

Comparative Example 2

The same optically anisotropic pitch as used in Example 2 was charged in a melt spinning machine having 200 nozzles, each having an inner diameter of 0.3 mm. The spinning pitch at a temperature of 320° C. was then discharged from each nozzle at a rate of 30 mg/min, and the discharged pitch was wound up around a spool having a diameter of 30 cm to obtain pitch fiber. As the winding speed was increased, the diameter of the fiber was decreased. Finally, when the winding speed exceeded 300 m/min, the diameter of the pitch fiber became 10 μm or less, and the pitch fiber snapped frequently. As a result, it became impossible to stably continue the spinning. Moreover, when the spinning temperature was raised to 370° C., which was the same temperature as in Example 2, the surfaces of the nozzles were wetted with the spinning pitch, and spinning could not be conducted.

Comparative Example 3

The same optically isotropic pitch as used in Example 1 was charged in a centrifugal spinning machine having 300 nozzles, each having an inner diameter of 0.5 mm, and was spinned at a temperature of 340° C. while revolving a centrifugal plate at a speed of 3500 rpm. The fiber thus obtained was subjected to infusibilization, and then carbonization at a temperature of 1000° C. It was found that the fiber thus obtained had a strength of 60 kg/mm$^2$, and a large average diameter of 15 μm.

Further, when the spinning temperature was raised to 350° C., which was the same temperature as in Example 1, the discharged pitch had the shape of a shot, and did not give fiber.

What is claimed is:

1. A method for producing pitch-type carbon fiber, comprising the steps of:

discharging, from a spinning nozzle, a spinning pitch comprising an optically isotropic pitch and/or optically anistropic pitch, maintained at such a temperature that the spinning pitch can have a viscosity of 20 poises or less, to form pitch fiber, while jetting a gas preheated to a temperature of 100° C. lower than the temperature at which the spinning pitch can have a viscosity of 20 poises or less, or higher from the periphery of he spinning nozzle at a jetting rate of 100 m/sec or more in the same direction as the discharging direction of the spinning pitch and parallel to the discharged pitch fiber to give an extremely fine fiber having an average diameter of 5 μm or less, and subjecting the thus spun fine fiber to infusibilization and carbonization.

2. The method according to claim 1, wherein the extremely fine fiber has an average diameter of 2 μm or less.

* * * * *